United States Patent [19]

Tsuchiya et al.

[11] Patent Number: 4,890,464

[45] Date of Patent: Jan. 2, 1990

[54] POSITIVE FEEDING DEVICE FOR CIRCULAR KNITTING MACHINE

[75] Inventors: Koji Tsuchiya; Yoshiaki Igarashi, both of Hyogo, Japan

[73] Assignee: Precision Fukuhara Works, Ltd., Hyogo, Japan

[21] Appl. No.: 242,492

[22] Filed: Sep. 12, 1988

[30] Foreign Application Priority Data

Mar. 18, 1988 [JP] Japan ..... 63-67013

[51] Int. Cl.[4] ..... D04B 15/48; D04B 35/10

[52] U.S. Cl. ..... 66/132 T; 66/157; 242/47.01; 242/47.12

[58] Field of Search ..... 66/132 T, 132 R, 157; 242/47.01, 47.12

[56] References Cited

U.S. PATENT DOCUMENTS

| | | | |
|---|---|---|---|
| 3,083,924 | 4/1963 | Vossen et al. | 66/132 R X |
| 3,672,590 | 6/1972 | Rosen | 242/47.12 |
| 4,004,438 | 1/1977 | Raisin | 66/132 T |
| 4,056,239 | 11/1977 | Fecker et al. | 242/47.01 |
| 4,355,747 | 10/1982 | Vinas | 66/132 T X |
| 4,457,144 | 7/1984 | Sawazaki | 66/132 T |
| 4,481,794 | 11/1984 | Sawazaki | 66/132 T |
| 4,598,560 | 7/1986 | Sawazaki | 66/132 T |
| 4,691,873 | 9/1987 | Gutschmit | 242/47.01 |

FOREIGN PATENT DOCUMENTS

| | | | |
|---|---|---|---|
| 854557 | 11/1952 | Fed. Rep. of Germany | 66/132 R |
| 2065723 | 7/1981 | United Kingdom | 66/132 T |

OTHER PUBLICATIONS

The Hosiery Trade Journal, 9/72, vol. 79, No. 945, p. 176.

*Primary Examiner*—Wm. Carter Reynolds

*Attorney, Agent, or Firm*—Bell, Seltzer, Park & Gibson

[57] ABSTRACT

Vertically stacked drive wheels ($17_1$, $17_2$, $17_3$ and $17_4$) are provided above a yarn feed wheel (21) which is provided with a first yarn feed surface (27) providing comparatively high friction with the yarn engaged thereby and adaptable for use when the rate of yarn feeding varies, such as in the case of Jacquard pattern knitting, and a second yarn feed surface (28) providing comparatively low friction against the yarn engaged thereby and adapted for use when the rate of yarn feeding is constant, such as in the case of plain knitting. Manually adjustable yarn guide means (29, 30) is provided for selectively guiding yarn to the first and second yarn feed surfaces (27, 28). Clutch members (24, 24') are interposed between pairs of the vertically stacked drive wheels and are selectively operable to impart rotation to the feed wheel (21) from a selected one of the drive wheels.

10 Claims, 2 Drawing Sheets

POSITIVE FEEDING DEVICE FOR CIRCULAR KNITTING MACHINE

FIELD OF THE INVENTION

This invention relates generally to a yarn feeding apparatus for a circular knitting machine including rotatable drive wheels with driven endless tape in driving engagement with the drive wheels, and more particularly to such a yarn feeding apparatus adaptable for use when the rate of yarn feeding varies, such as in the case of Jacquard pattern knitting, and for use when the rate of yarn feeding is constant, such as in the case of plain knitting.

BACKGROUND OF THE INVENTION

It is known to provide a circular knitting machine with a positive yarn feeding apparatus including endless drive tapes which engage a plurality of yarn feeding wheels driven at a predetermined rate in accordance with the operating speed of the knitting machine. The knitting yarns are guided between the tapes and the individual yarn feeding wheels so that the yarns are positively fed to the knitting stations as the endless drive tape is driven.

It is also known to provide a circular knitting machine with a storage type yarn feeding apparatus in which a predetermined quantity of yarn is maintained in storage by winding a suitable number of wraps on a feeding drum so that the yarn is constantly fed under a certain low degree of tension, according to the yarn feeding requirements of the knitting machine. In accordance with this arrangement, it is possible to provide yarn feeding during high speed operation of the knitting machine, and to also prevent any broken yarn end from being knit into the fabric when the yarn being fed is broken.

Recently, it has been the common practice to produce plain knit fabrics that have three or four feed repeat patterns on circular Jacquard machines. In most cases, these plain knit fabrics are of the type which involve no variation in the rate of yarn feeding, such as Milano rib and ponte de Roma. Knitting of these types of plain fabrics may be carried out by employing the aforesaid tape type positive yarn feeding apparatus or the storage type yarn feeding apparatus.

However, in the case of Jacquard pattern knitting in which varying rates of yarn feeding are required at adjacent knitting stations, it has been impossible to employ the tape type positive yarn feeding apparatus or the storage type yarn feeding apparatus because the varying yarn feeding rates required cannot be accomplished by these types of yarn feeding apparatus. Furthermore, for the purpose of pattern changing, it is necessary to relocate the yarn feeding apparatus each time a pattern change is required. In conjunction therewith, it is also necessary to arrange the space required for installation of the yarn feeding apparatuses. This is a very troublesome and time-consuming operation for an operator when pattern changes are required.

SUMMARY OF THE INVENTION

The present invention overcomes these difficulties encountered in the prior art yarn feeding devices by providing a yarn feeding apparatus capable of carrying out the yarn feeding function required for both plain knitting and Jacquard pattern knitting.

The yarn feeding apparatus of the present invention does not require yarn cutting each time when any change is made in plain knitting design, or in the Jacquard pattern design, and also eliminates the necessity of changing the location of the yarn feed arrangement when knitting pattern changes are required.

The yarn feeding apparatus of the present invention includes rotatable drive wheel means adapted to be driven by endless tape means, and yarn feed wheel means drivingly connected to the rotatable drive wheel means for rotating the yarn feed wheel means at the same speed as the rotatable drive wheel means. The yarn feed wheel means includes a first yarn feed surface providing comparatively high friction with the yarn engaged thereby and adaptable for use when the rate of yarn feeding varies, such as in the case of Jacquard pattern knitting, and a second yarn feed surface providing comparatively low friction against the yarn engaged thereby and adapted for use when the rate of yarn feeding is constant, such as in the case of plain knitting. Manually adjustable yarn guide means is provided for selectively guiding yarn to the first yarn feed surface to feed yarn to the circular knitting machine under variable feed rates, and for selectively guiding yarn to the second yarn feeding surface to feed yarn to the circular knitting machine under a constant feed rate. The present yarn feeding apparatus thus includes the combination of two different yarn feeding conditions.

The first yarn feed surface, which provides comparatively high friction, is formed by a rotating member with the surface being covered by a rubber band. The rubber band is preferably electrically conductive. The second yarn feed surface, which provides comparatively low friction, may be formed by a plurality of round metal bars arranged upright in a basket form. The second yarn feed surface may also be formed by a truncated and inverted cone-shaped metallic drum having a wear-resistant coating applied thereto. The manually adjustable yarn guide means is preferably movable in a radial direction around the yarn feed wheel means.

The yarn feed wheel is preferably rotated by means of a plurality of drive wheels supported for rotation in vertically stacked condition above the yarn feed wheel. It is usually preferred that the drive wheels be vertically stacked in two or four tiers and supported for rotation on a housing including horizontally spaced-apart support arms extending outwardly therefrom. The vertically stacked drive wheels are individually rotated by corresponding endless tapes engageable therewith. A clutch member is interposed between pairs of the drive wheels and is selectively operable to impart rotation to the yarn feed wheel by a selected one of the drive wheels.

The clutch members are supported for vertical movement between adjacent of the first and second pairs of drive wheels and may be raised to impart driving rotation to the yarn feed wheel by a corresponding drive wheel, may be lowered to impart driving rotation to the yarn feed wheel by a corresponding drive wheel, and may be moved to an intermediate position so that no rotation is imparted to the yarn feed wheel by a corresponding drive wheel. Clutch control means is provided for selectively maintaining selected ones of the clutch members out of driving engagement with adjacent of the drive wheels.

The clutch control means may be of a mechanical control type or of an electrical control type. The mechanical control type of clutch may be in the form of a pivot lever including vertically extending upper and lower arms with each of the arms having horizontally extending projections spaced apart a distance slightly greater than the thickness of the clutch members, and a horizontal operating arm including notches operable to maintain the pivoted lever in a selected position. The electrical control type of clutch includes clutch position indicating means in the form of a permanent magnet mounted on the outer periphery of the respective clutch members and a proximity switch positioned opposite and adjacent the respective permanent magnets.

In one mode of operation, the yarn is withdrawn from a supply source and is guided by a first yarn guide onto the first yarn feed surface providing comparatively high friction with the yarn engaged thereby and is then guide away from the second yarn feed surface by a second guide as the yarn is fed to the knitting machine. In accordance with another mode of operation, the yarn is passed through both the first and second yarn guides and is wound in a plurality of wraps directly onto the second yarn guide surface to provide a comparatively low friction against the yarn engaged thereby as the yarn is being fed to the knitting machine. By these two modes of operation, the yarn feeding apparatus of the present invention includes a combination of feeding functions applicable to both plain knitting and Jacquard pattern knitting.

BRIEF DESCRIPTION OF THE DRAWINGS

Other objects and advantages of the invention will appear as the description proceeds when taken in connection with the accompanying drawings, in which --

DESCRIPTION OF THE PREFERRED EMBODIMENTS

Figure 1:
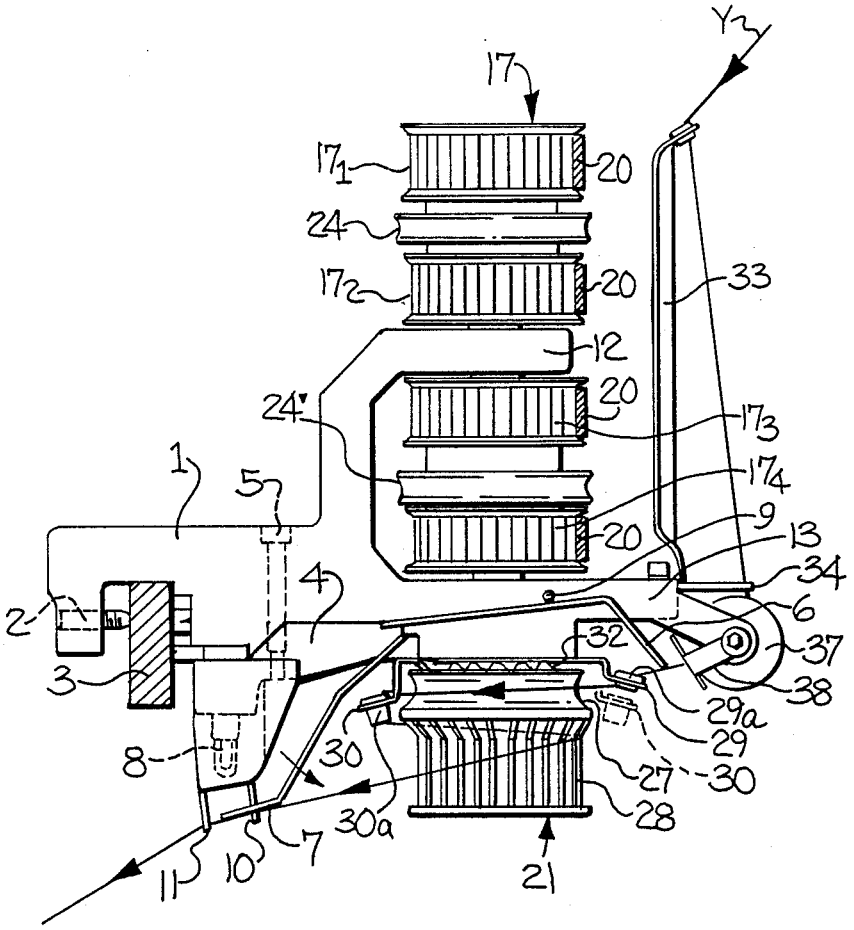
FIG. 1 is an elevational view of the yarn feeding apparatus of the present invention mounted on a circular support ring of the circular knitting machine.

The present yarn feeding apparatus includes a support housing 1 (FIG. 1) which is fixed by a screw 2 to a circular support ring 3 of a conventional type of circular Jacquard knitting machine, not shown. A lower cover 4 of a stop motion device is fixed to the housing 1 by a screw 5. Broken yarn detector levers 6, 7 are pivotally supported at one end on the lower cover 4 so that the incoming yarn Y and outgoing yarn supports the respective detector levers 6, 7. If the yarn supporting either of these detector levers 6, 7 is broken, the corresponding detector bar is pivotally moved downwardly, in the direction of the arrow, to cause a signal lamp 8 of the stop motion device to light up and to stop the operation of the knitting machine. Broken yarn detector lever 6 is restrained from upward movement by a stop pin 9. During a yarn feeding operation, the free end of the broken yarn detector lever 7 is positioned between two U-shaped wire yarn guides 10, 11 supporting the yarn Y exiting from the yarn feeding apparatus and extending to the knitting machine.

Figure 2:
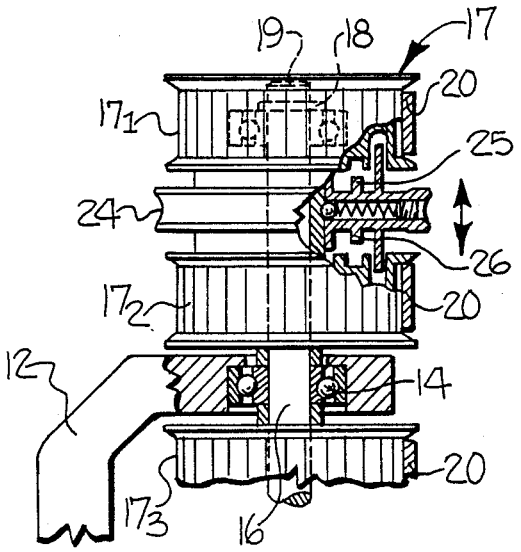
FIG. 2 is an enlarged fragmentary elevational view of the uppermost drive wheels, with parts in section to illustrate the rotational mounting of the drive shaft in the housing and the operation of the clutch member between adjacent drive wheels.
Figure 3:
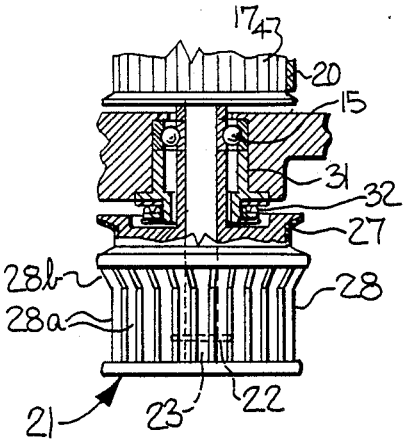
FIG. 3 is an enlarged fragmentary elevational view, with parts in section, and illustrating the manner in which the yarn feed wheel is mounted for rotation in the lower portion of the support housing.

The support housing 1 is provided with upper and lower horizontally extending and spaced-apart support arms 12, 13 in which a vertical drive shaft 16 is supported for rotation by respective upper ball bearing 14 (FIG. 2) and lower ball bearing 15 (FIG. 3). Drive wheel means, broadly indicated at 17, is supported on the upper end of the drive shaft 16 and includes four drive wheels $17_1$, $17_2$, $17_3$ and $17_4$ supported for rotation on the drive shaft 16 and in vertically stacked and paired condition. A nut 19 and washer 18 (FIG. 2) are provided on the upper end of the shaft 16. A housing 1 and drive wheel means 17 are provided at each of the knitting stations and supported in spaced-apart relationship on the circular support ring 3.

The individual drive wheels $17_1$, $17_2$, $17_3$ and $17_4$ are individually rotated by corresponding endless drive tapes 20 which extend around the circular knitting machine and engage the outer peripheral surfaces of the individual drive wheels. The endless drive tapes 20 are driven in the conventional manner and in timed relationship to operation of the circular knitting machine and the speed of the individual tapes 20 may be individually varied and controlled.

Yarn feed wheel means, broadly indicated at 21, is fixed on the lower end portion of the drive shaft 16 by means of a washer 22 and a nut 23 (FIG. 3). Respective upper and lower clutch members 24, 24' are supported for vertical movement and are fixed to rotate with the drive shaft 16. The clutch members 24, 24' are positioned between corresponding pairs of drive wheels $17_1$, $17_2$ and $17_3$, $17_4$. As shown in FIG. 2, the clutch members 24, 24' are each provided with respective upper and lower drive lugs 25, 26 which are adapted to project into corresponding drive holes in the adjacent pair of upper and lower drive wheels $17_1$, $17_2$ adjacent thereto. The clutches 24, 24' are adapted to be set in three vertical positions, upper, intermediate and lower, and remain in the selected one of these three set positions by means of detents and a spring pressed steel ball or the like.

The yarn feed wheel 21 is not rotated when the clutches 24, 24' are set in the intermediate positions, as shown in the position of the upper clutch 24 in FIG. 2, so that the drive wheels $17_1$, $17_2$, $17_3$ and $17_4$ do not rotate the drive shaft 16. Thus, the clutch members 24, 24' are selectively operable to impart rotation to the yarn feed wheel 21 from a selected one of the drive wheels $17_1$, $17_2$, $17_3$ and $17_4$. The selection of any one of the drive wheels to drive the yarn feed wheel 21 thus makes it possible to make any suitable changeover and selection and thereby eliminates the necessity of relocating the yarn feed wheel 21 in connection with changing the knitting pattern to be knit.

The yarn feed wheel 21 includes a first upper yarn feed surface 27 and a second lower yarn feed surface 28. The first yarn feed surface 27 is formed of an electroconductive material which provides relatively large or high friction with the yarn engaged thereby, such as a carbon-containing synthetic resin material covered with a rubber band. The second yarn feed surface 28 is formed of a low friction material against the yarn engaged thereby, for example, round metal bars **28*a*** (FIG.

3) arranged around the outer diameter and with their upper end portions being outwardly inclined as indicated at 28b. According to the modification shown in FIG. 7, the second yarn feed surface 28 is formed by a truncated inverted cone-shaped aluminum drum 28c having a wear-resistant coating applied thereto. The drum 28c may be either solid or hollow.

Figure 7:
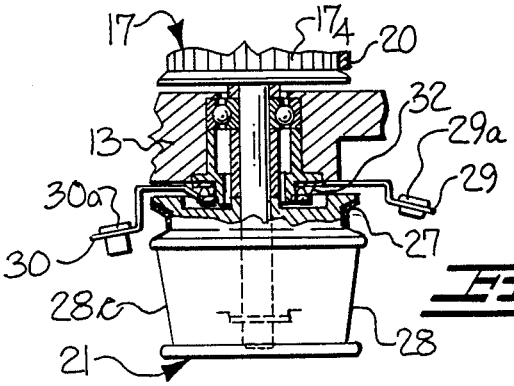
FIG. 7 is a view similar to FIG. 3 and illustrating an alternative type of yarn feed wheel.

As shown in FIGS. 1 and 7, a first manually adjustable yarn guide 29 is provided for guiding the yarn Y to the first yarn feed surface 27, and a second manually adjustable yarn guide 30 is provided for guiding the yarn to the second yarn feed surface 28. The movable yarn guides 29, 30 are provided with respective individual yarn guide eyelets 29a, 30a, for guiding the yarn Y to the first and second yarn feeding surfaces 27, 28. A resilient washer 32 (FIG. 3) is provided between the two movable guides 29, 30 so that the movable guides 29, 30 may be manually adjusted in a circumferential direction completely around a supporting sleeve member 31 fixed in the lower portion of the lower support arm 13 of the housing 1 (FIG. 3). In the case of Jacquard pattern knitting, the movable yarn guide 30 is circumferentially adjustable to vary the amount of contact of the yarn Y with the first yarn feed surface 27 as the yarn is directed from the yarn guide 29 to the yarn guide 30. The amount of contact of the yarn Y with the first yarn feed surface 27 may be increased or decreased according to the knitting stitch loop structure, or the type of yarn used. In the case of plain knitting, in which the rate of yarn feeding does not vary, yarn feeding is carried out by moving the movable yarn guide 30 in a circumferential direction to the dash-dot line position shown in FIG. 1 so that the guide 30 is positioned directly beneath the first yarn guide 29. Then, the yarn Y is fed through the aligned guides 29, 30 and directly onto the second yarn feed surface 28, thereby by-passing the first yarn feed surface 27. The yarn Y is then wrapped around the second yarn feeding surface 28 with any desired number of loops of yarn.

Figure 4:
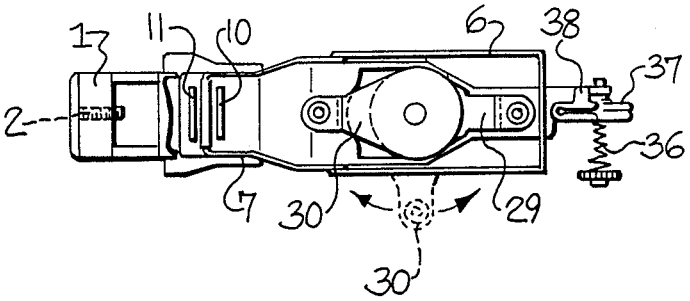
FIG. 4 is a bottom view looking upwardly in FIG. 1.

The outer free end of the lower support arm 13 has the lower end of an upright or vertical guide 33 fixed thereto for guiding the yarn Y from a yarn supply source, not shown, and downwardly to a wire guide 34 which is also supported by the outer free end of the lower support arm 13. A disk tension device 37 is supported below the guide 34 and the tension applied thereby to the yarn Y is adjustable by spring 36 (FIG. 4). A slub catcher 38 is supported adjacent the disk tension device 37.

In the embodiment thus far described, the upper and lower clutch members 24, 24' are manually moved to any one of the upper or lower driving positions, or to the intermediate nondriving position and are maintained in the selected position by the spring pressed steel ball illustrated in FIG. 2. However, it is preferred that clutch control means, as broadly indicated at 39 in FIG. 5, be provided opposite the clutches 24, 24' in order to positively maintain one of the clutch members in the neutral or nondriving position. The clutch control means 39 includes a pivot lever 40 pivotally supported on the upper support arm 12 on a pivot pin 40a. The pivot lever 40 includes respective upper and lower vertical arms 40b, 40c which are provided with respective pairs of outwardly extending and spaced-apart horizontally extending projections 40d, 40e. These projections 40d, 40e are spaced apart a distance slightly greater than the thickness of the clutch members 24, 24'.

The control lever 40 also includes a horizontal operating arm 40f including spaced-apart detents 40g which are engaged by a spring pressed ball, not shown, and operable to maintain the pivot lever 40 in a selected position. When the horizontal arm 40f is moved to the lowered position shown in solid lines in FIG. 5, the projections 40d and 40e of the upper arm 40b are positioned in straddling condition above and below the upper and lower surfaces of the clutch member 24 so as to prevent the clutch member 24 from being moved from the intermediate and nonrotating position. Thus, either one of the clutches 24, 24' can be maintained in the intermediate nonrotating position by appropriate movement of the clutch control lever 40.

Figure 5:
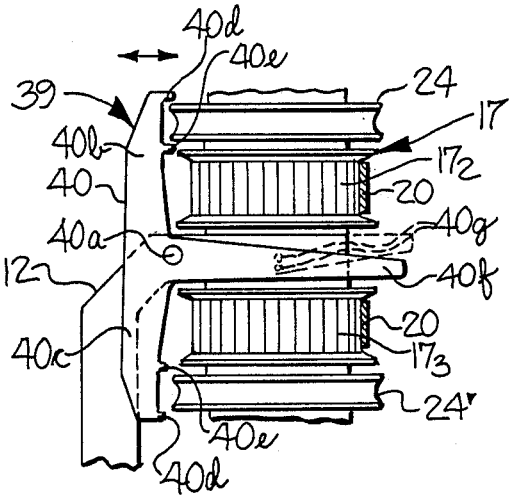
FIG. 5 is a view similar to FIG. 2 and illustrating one type of clutch control device.
Figure 6:
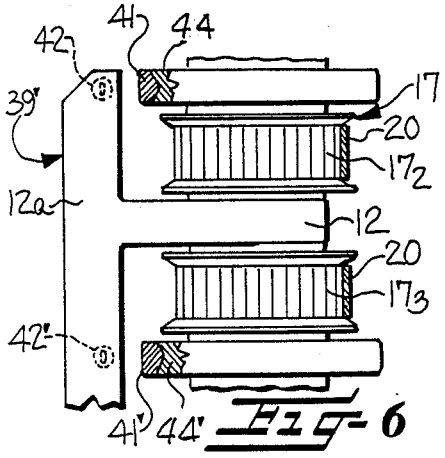
FIG. 6 is a view similar to FIG. 5 and showing an alternative type of clutch control device.

A modified form of clutch control means, in the form of clutch position indicating means broadly indicated at 39', is illustrated in FIG. 6. In this embodiment, permanent magnets 41, 41' are provided on the outer periphery of the respective clutch members 44, 44'. Corresponding magnetically operable proximity switches 42, 42' are supported on an upwardly extending portion 12a of the housing 1. In this modification, the proximity switches are connected to the usual stop motion of the knitting machine so that the knitting machine will not operate unless the corresponding clutch members 44, 44' are in the proper position. While only drive wheels $17_2$ and $17_3$ are shown in FIGS. 5 and 6, drive wheels similar to drive wheels $17_1$ and $17_4$ of FIG. 1 are positioned above and below the respective drive wheels $17_2$, $17_3$.

Method of Operation

As shown in FIG. 1, the yarn Y is withdrawn from a suitable yarn supply source, not shown, and is guided through the upper end of the upright guide 33, passes downwardly through wire guide 34, through tension disk 37, slub catcher 38 and into the eyelet 29a of the first movable yarn guide 29. The yarn Y passes beneath the broken yarn detector lever 6 before passing into the yarn guide eyelet 29a and is then guided onto the first yarn feed surface 27, which provides comparatively high friction. From the first yarn feed surface 27, the yarn Y passes through the yarn guide eyelet 30a of the movable yarn guide 30 and is directed around the second yarn feed surface 28 which provides comparatively low friction. After leaving the second yarn feed surface 28, the yarn passes over the yarn guides 10, 11 and beneath the free end of the detector lever 7 as it is fed to the circular knitting machine.

In the case of Jacquard pattern knitting, the yarn engages the first feeding surface 27 since the rate of yarn feeding varies and this first yarn feeding surface 27 provides comparatively high friction against the yarn engaged thereby. In the case of plain knitting, in which the rate of yarn feeding is not variable, the movable guide 30 is moved approximately 180 degrees from the solid line position shown in FIG. 1 to the dotted line position directly beneath the first yarn guide 29. The yarn Y is then passed directly through the first and second yarn guides 29 and 30, without being guided around or in engagement with the first yarn feed surface 27. Thus, the yarn Y is guided directly to the second yarn feed surface 28 where a multiplicity of ends are wound thereabout. In this case, the yarn Y is engaged by only the second yarn feed surface 28, providing comparatively small or low friction as it is fed to the circular knitting machine.

Thus, the yarn feeding apparatus of the present invention includes yarn feed wheel means 21 provided with a first yarn feed surface 27 providing comparatively high friction with the yarn engaged thereby and being adaptable for use when the rate of yarn feeding varies, such as in the case of Jacquard pattern knitting. The yarn feed wheel means 21 also includes a second yarn feed surface 28 providing comparatively low friction against the yarn engaged thereby and adapted for use when the rate of yarn feeding is constant, such as in the case of plain knitting. Manually adjustable yarn guides 29, 30 are provided for selectively guiding yarn to the first yarn feed surface 27 to feed yarn to the circular knitting machine under variable feed rates and for selectively guiding yarn directly to the second yarn feed surface 28 to feed yarn to the circular knitting machine under a constant feed rate so that these two different modes of yarn feeding can be selectively employed for different types of knitting, that is, plain knitting and Jacquard knitting.

Further, the present yarn feeding apparatus includes a plurality of drive wheels $17_1$, $17_2$, $17_3$ and $17_4$ supported for rotation in vertically stacked condition above the yarn feed wheel means 21 and with the individual drive wheels being individually rotated by corresponding endless drive tapes 20. Clutch members 24, 24' are interposed between pairs of the drive wheels and are selectively operable to impart rotation to the yarn feed wheel means 21 from a selected one of the drive wheels. With the clutch elements 24, 24' interposed between the drive wheels, it is possible to selectively use any one of the drive wheels by switching one to another by means of the clutches when changing the type of knit structure being knit. This makes it unnecessary to reset the yarn each time, as has been the practice in the past. This arrangement also eliminates the problem of providing such additional space as may be otherwise required for relocation and transfer of the yarn feeding apparatus when changing knit patterns. This present arrangement also provides ease of operation because individual yarn feed devices can be installed at a predetermined level without involving any difference of elevation from one feeding station to the next.

In the drawings and specification there have been set forth the best modes presently contemplated for the practice of the present invention, and although specific terms are employed, they are used in a generic and descriptive sense only and not for purposes of limitation, the scope of the invention being defined in the claims.

That which is claimed is:

1. In a yarn feeding apparatus for a circular knitting machine including rotatable drive wheel means (17), driven endless tape means (20) in driving engagement with said drive wheel means (17), yarn feed wheel means (21) drivingly connected to said drive wheel means (17) for rotating said yarn feed wheel means (21), the combination therewith wherein said yarn feed wheel means (21) includes a first yarn feed surface (27) providing comparatively high friction with the yarn engaged thereby and adaptable for use when the rate of yarn feeding varies, such as in the case of Jacquard pattern knitting, a second yarn feed surface (28) providing comparatively low friction against the yarn engaged thereby and adapted for use when the rate of yarn feeding is constant, such as in the case of plain knitting, and manually adjustable yarn guide means (29, 30) supported for circumferential movement around said yarn feed wheel means (21), said yarn guide means (29, 30) being movable to spaced-apart circumferential positions for selectively guiding yarn to said first yarn feed surface (27) to feed yarn to said circular knitting machine under variable feed rates, and said yarn guide means (29, 30) being movable to substantially circumferentially aligned positions for selectively guiding yarn to said second yarn feed surface (28) to feed yarn to said circular knitting machine under a constant feed rate.

2. A yarn feeding apparatus according to claim 1 wherein said first yarn guide surface (27) comprises a rubber band, and wherein said second yarn guide surface (28) comprises a plurality of round metal bars **(28*a*)** arranged upright so as to form a basket shape.

3. A yarn feeding apparatus according to claim 1 wherein said first yarn guide surface (27) includes an outer surface covered with a rubber band, and wherein said second yarn guide surface (28) is formed by a truncated and inverted cone-shaped metallic drum **(28*c*)** having a wear-resistant coating applied thereto.

4. A yarn feeding apparatus according to claim 1 wherein said drive wheel means (17) comprises a plurality of drive wheels ($17_1$, $17_2$, $17_3$ and $17_4$) supported for rotation in vertically stacked condition above said yarn feed wheel mans (21), and wherein said drive wheels ($17_1$, $17_2$, $17_3$ and $17_4$) are individually rotated by said endless tape means (20).

5. A yarn feeding apparatus according to claim 4 including horizontally spaced-apart support arms (12, 13) rotatably supporting said drive wheel means (17).

6. A yarn feeding apparatus according to claim 5 including a pair of clutch members (24, 24') interposed between pairs of said drive wheels ($17_1$, $17_2$, $17_3$ and $17_4$) and being selectively operable to impart rotation to said yarn feed wheel means (21) from a selected one of said drive wheels ($17_1$, $17_2$, $17_3$ and $17_4$).

7. A yarn feeding apparatus according to claim 6 wherein a first clutch member (24) of said pair of clutch members is supported for vertical movement between a first pair of said drive wheels ($17_1$, $17_2$), wherein a second clutch member (24') of said pair of clutch members is supported for vertical movement between a second pair of said drive wheels ($17_3$, $17_4$), and wherein said first and second clutch members (24, 24') may be manually raised to impart driving rotation to said yarn feed wheel means (21) by a corresponding drive wheel ($17_1$, $17_2$), may be manually lowered to impart driving rotation to said yarn feed wheel means (21) by a corresponding drive wheel ($17_3$, $17_4$), and may be manually moved to an intermediate position so that no rotation is imparted to said yarn feed wheel means (21) by a corresponding drive wheel ($17_1$, $17_2$ and $17_3$, $17_4$).

8. A yarn feeding apparatus according to claim 5 including clutch control means (39) for selectively maintaining selected of said clutch members (24, 24') out of driving engagement with adjacent of said drive wheels ($17_1$, $17_2$, $17_3$ and $17_4$).

9. A yarn feeding apparatus according to claim 8 wherein said clutch control means (39) comprises a pivot lever (40) including respective vertically extending upper and lower arms **(40*b*, 40*c*), each of said arms (40*b*, 40*c*) including two horizontally extending projections (40*d*, 40*e*) spaced apart a distance slightly greater than the thickness of said clutch members (24, 24') and a horizontal operating arm (40*f*) including detents (40*g*) operable to maintain said pivot lever (40)** in a selected position.

10. A yarn feeding apparatus according to claim 5 wherein said clutch control means includes clutch position indicating means (39') comprising a permanent magnet (41, 41') mounted on the outer periphery of said respective clutch members (24, 24'), and proximity switches (42, 42') disposed opposite and adjacent said respective permanent magnets (41, 41').

* * * * *